US006039619A

United States Patent [19]

Kang et al.

[11] Patent Number: 6,039,619

[45] Date of Patent: Mar. 21, 2000

[54] METHOD AND APPARATUS FOR MANUFACTURING PARTITION WALL OF PLASMA DISPLAY DEVICE

[75] Inventors: Young-Cheol Kang, Suwon; Byung-Hak Lee, Ansan; Man-Ho Song, Seoul, all of Rep. of Korea

[73] Assignee: Samsung Display Devices Co., Ltd., Kyungki-do, Rep. of Korea

[21] Appl. No.: 09/083,048

[22] Filed: May 22, 1998

[30] Foreign Application Priority Data

| | | | |
|---|---|---|---|
| May 22, 1997 | [KR] | Rep. of Korea | 97-11978 |
| May 22, 1997 | [KR] | Rep. of Korea | 97-19976 |
| May 22, 1997 | [KR] | Rep. of Korea | 97-19977 |
| Jul. 15, 1997 | [KR] | Rep. of Korea | 97-32827 |

[51] Int. Cl.[7] ..... H01J 9/00

[52] U.S. Cl. ..... 445/24; 445/70

[58] Field of Search ..... 445/24, 70; 313/584

[56] References Cited

U.S. PATENT DOCUMENTS 5,876,542 3/1999 Fujiwara ..... 445/24

FOREIGN PATENT DOCUMENTS 0875915 11/1998 European Pat. Off. .
8273538 10/1996 Japan .

*Primary Examiner*—Kenneth J. Ramsey
*Attorney, Agent, or Firm*—Leydig, Voit & Mayer, Ltd.

[57] ABSTRACT

A method for manufacturing a partition wall of a plasma display device includes (a) providing a substrate and a block in which partition wall forming grooves having the same pattern as that of partition walls are formed; (b) positioning the substrate on the block; (c) pressing the substrate against the block such that part of the substrate is inserted into the partition wall forming grooves to form the partition walls; and (d) separating the substrate from the block.

22 Claims, 5 Drawing Sheets

METHOD AND APPARATUS FOR MANUFACTURING PARTITION WALL OF PLASMA DISPLAY DEVICE

BACKGROUND OF THE INVENTION

1. Field of the Invention

The present invention relates to a method and apparatus for manufacturing a partition wall for partitioning a discharge space of a plasma display device.

2. Description of Related Art

A plasma display device produces a discharge in a specific gas and excites a fluorescent material to form an image. The discharge is caused by applying a voltage between two electrodes in a closed space containing a gas. A picture is formed by exciting a patterned fluorescent layer with ultraviolet rays generated from the gas discharge.

The plasma display device includes a partition wall between an upper substrate and a lower substrate defining a discharge space. At least a pair of electrodes for a main discharge or a supplementary discharge are located in the discharge space according to the kind of plasma display device. The partition wall is generally formed on the upper surface of the lower substrate. A method for forming the partition wall according to a conventional printing method will be described with reference to FIG. 1.

As shown in FIG. 1, an electrode layer 12 having a predetermined pattern is formed on the upper surface of a substrate 11 and a dielectric layer 13, an insulating layer, is formed on the upper surface thereof. A partition wall 15 is formed by putting a screen 14 having the same pattern as that of the partition wall on the upper surface of the dielectric layer 13, repeatedly printing the material of the partition wall at a thickness of 10 through 15 $\mu$m, and drying and curing the material.

In the described method, deformation of the pattern of the partition wall must occur due to the repetition of printing, drying, and curing processes in forming the partition wall 15. In particular, the substrate and the screen must be repeatedly aligned to repeatedly print the partition wall. In this process, the precision in forming the partition wall may be lowered due to a misalignment.

Another conventional method for forming the partition wall on the lower substrate is shown in FIGS. 2A through 2C. As shown in FIG. 2A, a partition layer 24 having a thickness corresponding to a height of the partition wall is formed on the upper surface of a substrate 23 on which an electrode layer 21 and a dielectric layer 22 having a pattern are sequentially formed. As shown in FIG. 2B, an abrasion preventing mask 25 is formed on the partition layer 24 using a photoresist method. Any material which is not abraded by blasted sand can be used as the abrasion preventing mask 25. Then, as shown in FIG. 2C, sand is blasted against the upper surface of the partition layer 24 with air or water at a high pressure to abrade a portion where the abrasion preventing mask 25 is not present, forming a discharge space.

Some part of the partition layer 24 which was not abraded becomes a partition wall 26. However, in such a method, processes for forming the abrasion preventing mask 25 are complicated. Since the material of the partition wall is removed as a fine powder, the work is contaminated and an additional washing process for removing the sand attached to the partition wall is necessary. In this method, a lot of time is required for forming the partition wall.

SUMMARY OF THE INVENTION

It is an object of the present invention to provide a method and apparatus for manufacturing a partition wall of a plasma display device in which partition walls are easily formed through simple processes.

To achieve the above object, there is provided a method for manufacturing a partition wall of a plasma display device comprising (a) providing a substrate and a block in which partition wall forming grooves having the same pattern as that of partition walls are formed; (b) providing a substrate including a coating layer for easily separating the block from the substrate; (c) positioning the substrate on the block; (d) pressing the substrate against the block such that part of the substrate is inserted into the partition wall forming grooves to form partition walls; and (e) separating the substrate from the block.

According to another aspect of the present invention, there is provided a method for manufacturing a partition wall of a plasma display device comprising (a) providing a substrate on which a partition layer is formed of a partition wall material and a block in which partition wall forming grooves having the same pattern as that of partition walls are formed; (b) providing a substrate having the partition wall forming layer and a coating for easily separating the partition wall forming layer from the block on the partition wall forming layer; (c) positioning the substrate on the block such that the partition layer contacts the block; (d) pressing the substrate against the block so that part of the partition layer is inserted into the partition wall forming grooves, thus forming the partition wall; (e) separating the substrate from the block; and (f) curing the partition layer.

According to still another aspect of the present invention, there is provided an apparatus for manufacturing partition walls of a substrate in a plasma display device comprising a block in which partition wall forming grooves having the same pattern as that of the partition walls and a connecting path connected to the partition wall forming grooves are formed; a pump connected to the connecting path for applying a predetermined pressure; and a press for pressing a substrate against the block.

BRIEF DESCRIPTION OF THE DRAWINGS

The above objects and advantages of the present invention will become more apparent by describing in detail a preferred embodiment with reference to the attached drawings in which.

DESCRIPTION OF THE PREFERRED EMBODIMENTS

Figure 1:
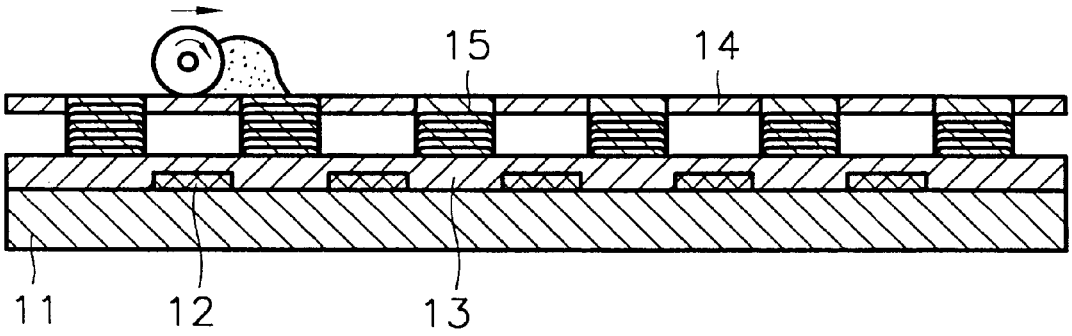
FIG. 1 (PRIOR ART)
FIG. 1 is a sectional view illustrating a conventional method for manufacturing a partition wall.
Figure 2A:
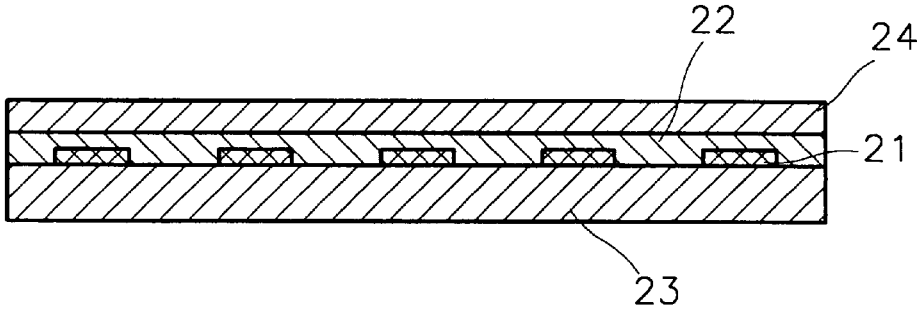
FIG. 2A (PRIOR ART)
FIGS. 2A through 2C are sectional views showing another example of a conventional method for manufacturing a plasma display device.
Figure 2B:
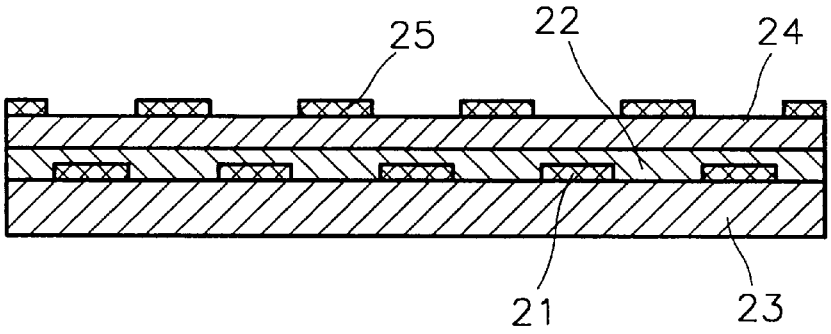
FIG. 2B (PRIOR ART)
Figure 2C:
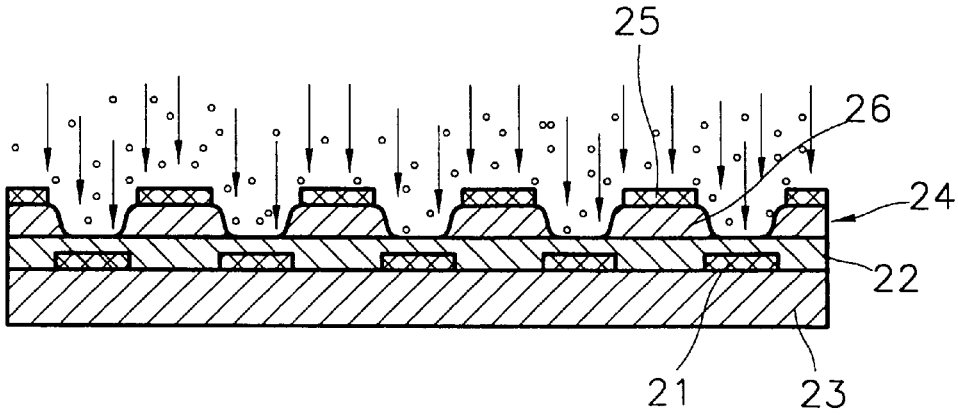
FIG. 2C (PRIOR ART)
Figure 3A:
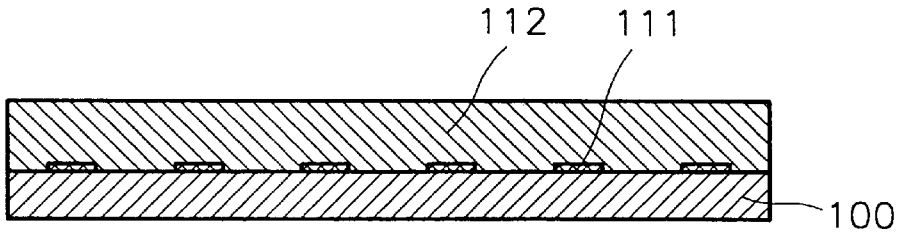
FIGS. 3A through 3G show a method for manufacturing a plasma display device according to the present invention.
Figure 3B:
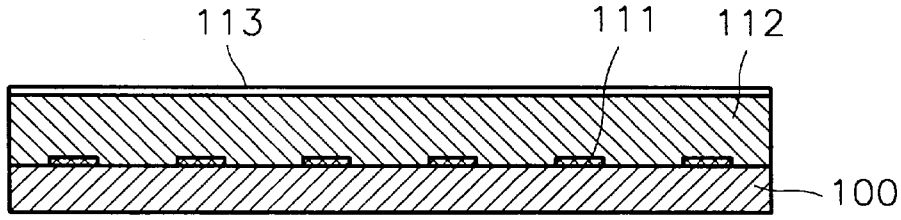
Figure 3C:
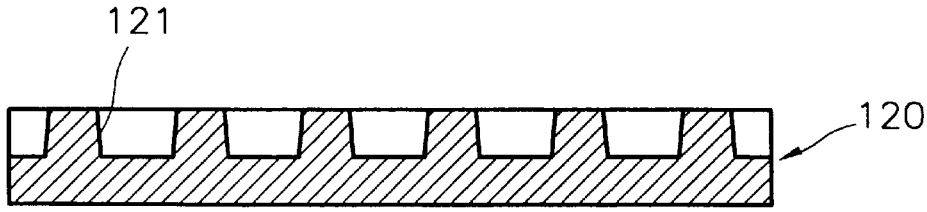

According to a partition wall manufacturing method of a preferred embodiment of the present invention, as shown in FIG. 3A, address electrodes 111 having a predetermined pattern are formed on a substrate 100, for example, $SiO_2$ as the partition wall material is applied, forming a partition layer 112 having a predetermined height. The partition layer 112 may be formed by thick film printing, roll coating, or spin coating. A coating layer 113 for easily separating the partition layer 112 from a block used in the following step is formed on the partition layer 112 as shown in FIG. 3B. The coating layer is preferably formed using a glass paste. The glass paste is a mixture including spheres of $Al_2O_3$ or $TiO_2$, a low melting point glass such as PbO—$B_2O_3$—$SiO_2$, and a bonding agent such as polymethacrylate. The oxide powder provides strength and the glass bonds the powder at an elevated temperature to provide strength. The coating layer 113 includes a low melting point glass and an organic solvent. Isoparaffin is a preferred organic solvent and PbO—$B_2O_3$—$SiO_2$ is preferably the low melting point glass. A block 120 having partition wall forming grooves 121 in the same pattern as that of a desired partition wall is manufactured, as shown in FIG. 3C. The partition wall forming grooves 121 preferably have a height equal to that of a desired partition wall.

Figure 3D:
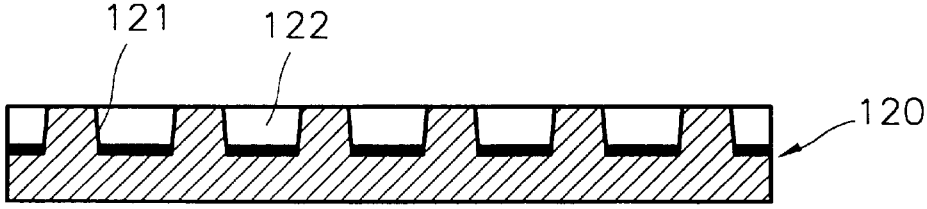

As shown in FIG. 3D, a non-emitting absorbing material layer 122 is formed in the partition wall forming grooves 121 in the block 120. The non-emitting absorbing material layer 122 is the same material as the coating layer, for example, a mixture of a low melting point glass, such as PbO—$B_2O_3$—$SiO_2$, and an oxide powder, such as CuO or $C_2O$. A black pigment is mixed with the non-emitting absorbing material.

Figure 3E:
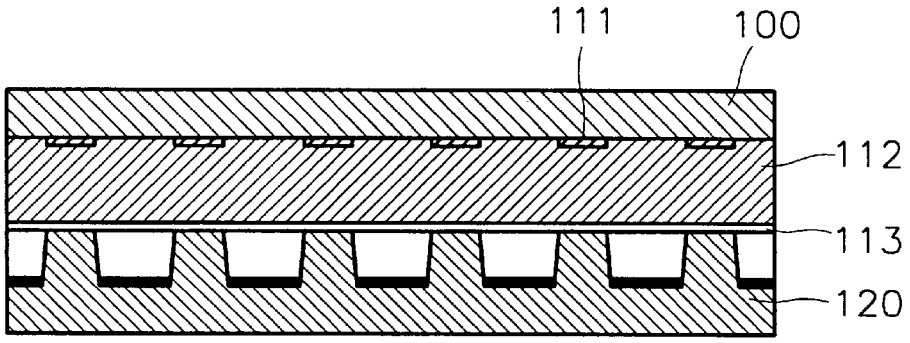
Figure 3F:
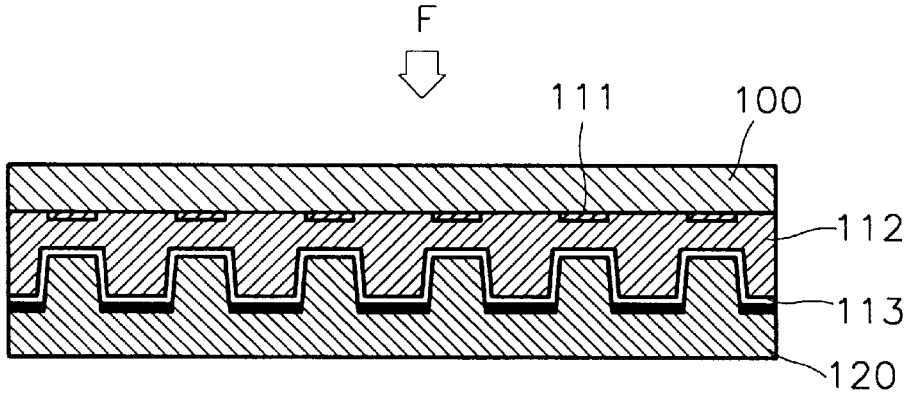

As shown in FIG. 3E, the partition layer 112 is located on the block 120, heated, and softened. When the partition layer 112 is fully softened, some part of the partition layer 112 is inserted into the partition wall forming grooves 121 by pressing the upper surface of the substrate 100 with a force 'F' as shown in FIG. 3F. It is preferable that a vacuum pressure be applied to the partition wall forming grooves 121 by forming a hole (not shown) connected to the partition wall forming grooves 121 in the block to facilitate the insertion of the partition layer 112.

Figure 3G:
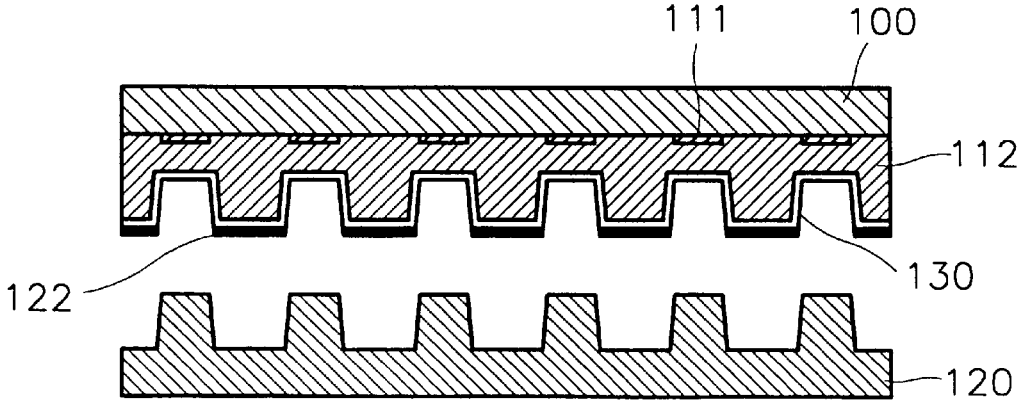

Then, as shown in FIG. 3G, partition walls 130 are formed by separating the substrate 100 and the partition layer 112 from the block 120. The non-emitting absorbing material layer 122 in the partition wall forming grooves 121 is positioned on the partition walls 130. The block is easily separated from the substrate 100 since the coating layer 113 is present on the substrate. However, it is preferable that a predetermined air pressure be applied to the partition wall forming grooves 121 to facilitate the separation of the partition layer 112. Since the non-emitting absorbing material layer is the same material as the coating layer, the absorbing material layer is not separated from the coating layer when the block is separated from the substrate.

In the present invention, a curing process may be further included depending on the material of the partition layer 112. For example, the partition layer 112 is plastic-cured when the partition layer 112 is a thermoplastic compound of a ceramic and an organic material.

Figure 4:
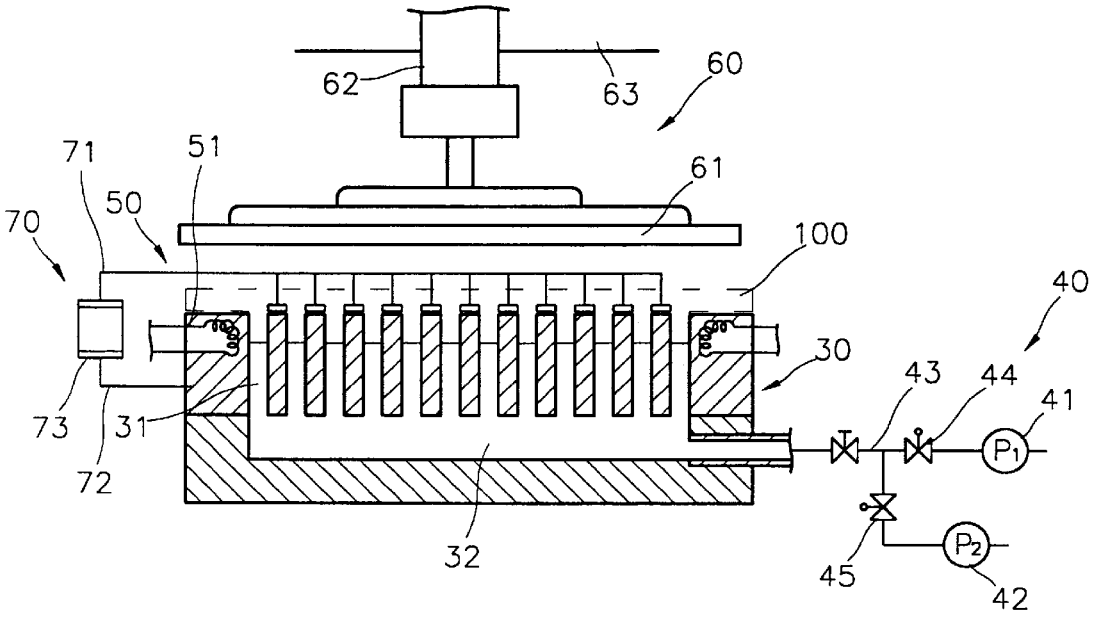
FIG. 4 is a sectional view showing an apparatus for manufacturing a plasma display device according to an embodiment of the present invention.

FIG. 4 shows an apparatus for manufacturing a partition wall of a plasma display device according to another aspect of the present invention. As shown in FIG. 4, the apparatus for manufacturing the partition wall of the plasma display device includes a block 30 having partition wall forming grooves 31 in the same pattern as the partition wall. A connecting path 32 leading to the partition wall forming grooves 31 is formed at the lower portion of the inside of the block 30. The arrangement of the partition wall forming grooves 31 in the block 30 is not restricted to this embodiment and may vary according to the pattern of the partition wall to be formed. The partition wall forming grooves 31 have a depth equal to or greater than a height of the desired partition wall. Though not shown in the drawing, a partition plate in which a minute through hole connected to the connecting path can be formed in the partition wall forming grooves. Also, the block 30 is preferably made of a material having the same thermal expansion rate as that of the substrate 100 to compensate for the thermal expansion of the substrate 100.

Preferably, a ceramic or Teflon coating is applied to the upper surfaces of the block 30 and the inner surfaces of the partition wall forming grooves 31 for easily separating the manufactured partition wall from the substrate 100.

The connecting path 32 is connected to a pumping unit 40 for applying a vacuum or a high pressure to the partition wall forming grooves 31. The pumping unit 40 includes a vacuum pump 41 and a high pressure pump 42 for providing a vacuum and a high pressure to the connecting path 32 through the connecting pipe 43, respectively. First and second valves 44 and 45 are used for connecting or blocking paths between the vacuum and high pressure pumps 41 and 42 and the connecting path 32.

A heating unit 50 for softening the substrate 100 set on the upper portion of the block 30 is installed in the block 30. The heating unit 50 includes a heater 51 embedded in the block 30. Alternatively, the heating unit 50 may include a burner (not shown) for heating the substrate 100 and the block 30 or a ventilator for providing hot air to the substrate 100 and the block 30.

Also, a press 60 for pressing the substrate 100 against the block 30 is installed above the block 30. The press 60 includes a pressing plate 61, the lower surface of which is flat, and an actuator 62 fixed to a frame 63 for lifting and lowering the pressing plate 61 with respect to the block 30. In general, air or hydraulic cylinders are used as the actuator 62.

The apparatus for forming the partition wall of a plasma display device according to the present invention further includes an alignment unit 70 for aligning the substrate 100 with respect to the block 30. When address electrodes 111 (see FIG. 3) are formed in the substrate 100, the substrate 100 is aligned by the alignment unit 70 such that the portion where the address electrodes 111 are formed is located on the block 30 between the partition wall forming grooves 31. The alignment unit 70 arranges the substrate 100 by measuring a capacitance between the address electrode 111 and the block 30. The alignment unit 70 includes a first lead 71 connected to the address electrode 111, a second lead 72 connected to the block 30, and a capacitance measuring instrument 73 for measuring the capacitance between the address electrode 111 and the block 30. Though not shown, the alignment unit may comprise an arrangement mark on the substrate 100 and the block 30 for alignment.

A process of manufacturing a partition wall using the apparatus according to the above-mentioned embodiment of the present invention will now be described.

First, the substrate 100 is put on the block 30. At this time, a material forming the non-emitting absorbing material layer can be injected into the partition wall forming grooves 31 in the block 30.

The substrate 100 is arranged by the alignment unit 70 so that the portion where the address electrode 111 is positioned is between the partition wall forming grooves 31. The substrate 100 is located at a position where the capacitance between the substrate 100 and the block 30, measured by the capacitance measuring instrument 73, becomes maximal; in other words, the distance between the address electrode 111 and the block 30 is minimal.

When the substrate 100 is arranged, the substrate 100 is softened by heating the block 30 and the substrate 100 using the heating unit 50. The substrate 100 may be pre-heated by an additional heating means before it is put on the block 30. In this case, the time required for softening the substrate can be shortened.

When the substrate 100 is softened, the vacuum pump 41 is driven with the first valve 44 opened and the second valve 45 closed, respectively, to produce a vacuum in the partition wall forming grooves 31. Then, the actuator 62 of the press 60 is operated such that the pressing plate 61 presses the softened substrate 100 against the block 30. Accordingly, a part of the substrate 100 or the partition layer formed on the substrate 100 is inserted into the partition wall forming grooves 31 to form the partition walls while the softened substrate 100 is deformed.

When the formation of the partition wall is completed, the high pressure pump 42 is driven to provide a high pressure to the partition wall forming grooves 31 while the first valve 44 is closed and the second valve 45 is opened. Accordingly, the partition walls of the substrate 100 come out from the partition wall forming grooves 31, so that the substrate 100 is separated from the block 30. The separated substrate 100 is cooled and cured. The height of the partition wall formed through these processes can be appropriately controlled by controlling the depth of the partition wall forming grooves 30 or the pressing force of the press 60.

Figure 5:
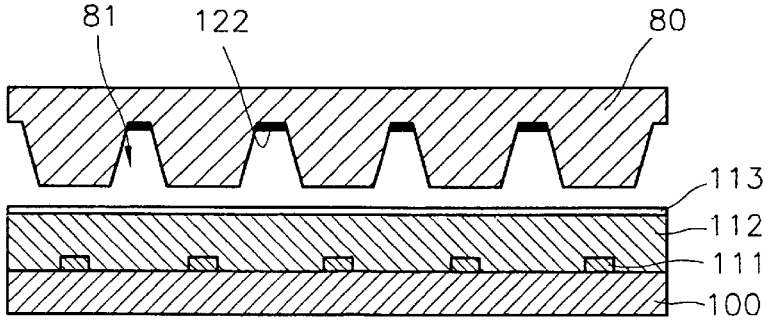
FIG. 5 is a sectional view showing an apparatus for manufacturing the partition wall of a plasma display device according to another embodiment of the present invention.

A partition wall manufacturing apparatus according to another embodiment of the present invention is shown in FIG. 5. Referring to FIG. 5, the apparatus includes a mold 80 having partition wall forming grooves 81 in the same pattern as the partition wall in order to form the partition walls in the partition layer 112 of the substrate 100 in which address electrodes 111 are located. When the mold 80 presses the partition layer 112 in a state in which the non-emitting absorbing material layer is formed in the partition wall forming grooves 81, some part of the partition layer 112 is deformed and inserted into the partition wall forming grooves 81, thus forming the partition walls on which the non-emitting absorbing material layer is positioned. After the partition walls are formed, the substrate 100 is separated from the mold 80 and cured.

A ceramic or Teflon coating film is preferably formed on the surface of the mold so that the substrate and the partition layer are easily separated. Also, the apparatus of the present embodiment can further include an alignment unit (not shown) for arranging the substrate in the mold.

According to the method and apparatus for manufacturing the partition wall of a plasma display device of the present invention, it is possible to mass-produce substrates having a complicated structure of partition walls and to arbitrarily control the height of the partition wall. Also, an inferiority rate and manufacturing steps are reduced compared with a conventional printing method in which a pattern is repeatedly printed.

The present invention is not restricted to the above-mentioned embodiments and many variations are possible within the scope and spirit of the present invention by any one skilled in the art.

We claim:

1. A method for manufacturing a partition wall of a plasma display device comprising:

(a) providing a substrate and a block in which partition wall forming grooves having the same pattern as that of partition walls are formed;

(b) providing a substrate including a coating layer for easily separating the block from the substrate;

(c) positioning the substrate on the block;

(d) pressing the substrate against the block such that part of the substrate is inserted into the partition wall forming grooves to form partition walls; and (e) separating the substrate from the block.

2. The method as claimed in claim 1, comprising forming a non-emitting absorbing material layer in the partition wall forming grooves in the block between (a) and (b).

3. The method as claimed in claim 1, comprising heating the substrate positioned on the block to soften the substrate.

4. The method as claimed in claim 1, wherein (d) comprises producing a vacuum in the partition wall forming grooves such that the part of the substrate is easily inserted into the partition wall forming grooves.

5. The method as claimed in claim 1, wherein (e) comprises applying a high pressure to the partition wall forming grooves so that the substrate is easily separated from the block.

6. The method as claimed in claim 1, wherein (c) comprises aligning the substrate with respect to the block.

7. The method as claimed in claim 1, wherein the coating is a glass paste.

8. A method for manufacturing a partition wall of a plasma display device, comprising:

(a) providing a substrate on which a partition layer is formed of a partition wall material and a block in which partition wall forming grooves having the same pattern as that of partition walls are formed;

(b) providing a substrate having the partition wall forming layer and a coating for easily separating the partition wall forming layer from the block on the partition wall forming layer;

(c) positioning the substrate on the block such that the partition layer contacts the block;

(d) pressing the substrate against the block so that part of the partition layer is inserted into the partition wall forming grooves, thus forming the partition wall;

(e) separating the substrate from the block; and (f) curing the partition layer.

9. The method as claimed in claim 8, comprising forming a non-emitting absorbing material layer in the partition wall forming grooves of the block after (a).

10. The method as claimed in claim 8, comprising forming a coating for easily separating the partition wall from the block, on the partition wall forming layer before (c).

11. The method as claimed in claim 10, wherein the partition wall material is a thermoplastic compound of a ceramic and an organic material.

12. The method as claimed in claim 8, comprising heating the substrate and the partition layer positioned on the block to soften the partition layer.

13. The method as claimed in claim 8, wherein (d) comprises producing a vacuum in the partition wall forming grooves so that part of the partition layer is easily inserted into the partition wall forming grooves.

14. The method as claimed in claim 8, wherein (e) comprises applying a high pressure to the partition wall forming grooves so that the substrate is easily separated from the block.

15. An apparatus for manufacturing partition walls of a substrate in a plasma display device comprising:

a block including partition wall forming grooves having the same pattern as that of the partition walls and a connecting path leading to the respective partition wall forming grooves;

a pump connected to the connecting path for applying a predetermined pressure; and a press for pressing a substrate against the block.

16. The apparatus as claimed in claim 15, comprising a heating unit for heating a substrate positioned on the block to soften the substrate.

17. The apparatus as claimed in claim 15, wherein the press comprises a pressing plate, the lower surface of which is flat, and an actuator for lifting and lowering the pressing plate with respect to the block.

18. The apparatus as claimed in claim 15, wherein the pump comprises:

a connecting pipe connected to the connecting path;

a vacuum pump and a high pressure pump connected to the connecting pipe; and a plurality of valves installed in the connecting pipe for controlling application of pressure from the vacuum pump and the high pressure pump to the connecting path.

19. The apparatus as claimed in claim 15, including a ceramic or Teflon coating film on an upper surface of the block and an inner surface of the partition wall forming grooves.

20. The apparatus as claimed in claim 15, comprising an alignment unit for positioning a substrate with respect to the block.

21. The apparatus as claimed in claim 20, wherein the alignment unit comprises a capacitance measuring instrument for measuring a capacitance between an address electrode formed on the substrate and the block so that a substrate is aligned at a position where the capacitance is maximal.

22. The apparatus as claimed in claim 15, wherein the block has the same thermal expansion rate as a substrate.

* * * * *